United States Patent [19]

Mickelson

[11] 4,372,136

[45] Feb. 8, 1983

[54] LOCK PROTECTING HASP

[75] Inventor: Thorwald J. Mickelson, Excelsior, Minn.

[73] Assignee: Transportation Security Inc., Eden Prarie, Minn.

[21] Appl. No.: 181,949

[22] Filed: Aug. 27, 1980

[51] Int. Cl.[3] ..... E05B 73/00; E05C 19/18

[52] U.S. Cl. ..... 70/14; 70/91; 70/200; 70/238; 70/DIG. 65; 292/288

[58] Field of Search ..... 70/91, 101, 54–57, 70/14, 200, 203, 212, 238, DIG. 65; 292/288

[56] References Cited

U.S. PATENT DOCUMENTS

| | | | |
|---|---|---|---|
| 3,550,409 | 12/1970 | Pariser | 70/238 X |
| 3,664,164 | 5/1972 | Zaidener | 70/238 X |
| 3,690,131 | 9/1972 | Davis | 70/238 X |
| 3,727,438 | 4/1973 | Knaack | 70/56 X |
| 3,740,978 | 6/1973 | Smith et al. | 70/55 X |
| 4,003,227 | 1/1977 | Casey | 70/14 |
| 4,041,738 | 8/1977 | Vann | 70/212 |

*Primary Examiner*—William E. Lyddane

*Attorney, Agent, or Firm*—Hugh D. Jaeger

[57] ABSTRACT

Lock-protecting hasp for trailer full swing rear doors having locking bars which secures to the bars of the rear doors and includes two mating members and a shackle lock whether the lock be key or combination. A protecting block against the lock on the female mating member protects the shackle of the lock from being cut or pried off the body of the lock, or between the shackle, the body and the lock-protecting hasp. Longitudinal opposing slots and a ribbed locking bar on the male mating member provide for adjustability between the two members for accepting door bars spaced any distance dependent upon the type of trailer. The lock-protecting hasp particularly lends itself to use on semi-trailers having full swing rear doors and the lock-protecting hasp accepts a lock of predetermined size.

12 Claims, 7 Drawing Figures

LOCK PROTECTING HASP

BACKGROUND OF THE INVENTION

1. Field of the Invention

The present invention pertains to locking members, and more particularly, pertains to a lock-protecting hasp including two mating members for trailers or containers.

2. Description of the Prior Art

There has been a longfelt need for a lock-protecting hasp which will protect shackle locks, especially protecting the locks from bolt cutters or pry bars. There has been a special need for suitable lock-protecting hasps on semi-trailers or containers.

Prior art semi-trailers have used shackle locks which have been easy to remove by cutting the shackle with a bolt cutter or inserting a pry bar into the shackle which is engaged in a lock on a semi-trailer, and prying the lock away from the hasp on the semi-trailer. While some have tried to use stronger case hardened locks, this has not solved the problem. Some companies do not even use locks, but just use a stranded wire with a lead seal hoping that the wire/seal arrangement will deter breakins. Such is often not the case.

The prior art door handles which swing 180° to lock the door in position, and then drop down 90° to engage against a hasp for subsequently accepting a shackle block have provided easy access by removing the shackle lock either with bolt cutters or pry bar. This is so because the lock is exposed in an open view to an individual who can either cut the shackle or pry the shackle with respect to the body of the lock.

The present invention overcomes the disadvantages of prior art by providing a lock-protecting hasp which fully encloses and protects not only the shackle of the lock with respect to the lock body but also provides an outside protector block substantially encompassing the shackle of the lock thereby preventing cutting or prying of the shackle from the body of the lock.

SUMMARY OF THE INVENTION

The general purpose of the present invention is to provide a lock-protecting hasp for encompassing the shackle and body of the lock and for use on full swing rear doors of a semi-trailer or container. The lock-protecting hasp is adjustable and easy to use by a tractor/trailer driver or any other individual, and requires no manual dexterity or skill to lock the lock into position over the bars of the doors.

According to one embodiment of the present invention, there is provided a lock-protecting hasp including male and female mating and opposing mounting hasps of a J-shaped structure, two elongated opposing holes in the leg of each J for accepting a shackle of a lock and including outer radial circumferences on each of the elongated holes providing for rotation of the shackle of the lock in each leg, longitudinal opposing slots in the male mating J member and including a longitudinal ribbed locking bar positioned between the slots on the inside of the J member, longitudinal channels running substantially the length of the female mating J member on the inside of the J member, and a protector block secured to the outer end of the outside of the J mating member and adjacent the elongated holes whereby the members are mated together and hooked around the bars of the doors respectively, and a shackle lock engages through opposing align holes in one end of the leg and through opposing slots of the male member thereby being adjusted and engaged into a locking position where the shackle engages between the ribs of the ribbed locking bar. The protector block covers any area of freedom about the shackle lock body, preventing any exposed portions of the shackle or lock body from prying by pry bar or cutting by bolt cutter.

A significant aspect and feature of the present invention is a lock-protecting hasp which protects the shackle of the lock. The lock-protecting hasp consumes any extra space through the adjustable ribbed member. The lock-protecting hasp accepts any shackle lock of predetermined size, and is especially intended for use with case-hardened locks such as the Abeloy Lock made in Finland.

Another significant aspect of the present invention is a lock-protecting hasp which takes a considerable period of time, much longer than three minutes, to gain access past the lock-protecting hasp. The only foreseeable way of removing the lock-protecting hasp would be with a cutting torch which would not only take a considerable period of time and require heavy equipment such as acetylene tanks, but would also attract a considerable amount of attention, especially when sparks would start flying, whether it would be day or night, during the cutting process.

Another significant aspect of the present invention is a lock-protecting hasp which provides absolute security and keeps doors locked, especially doors of a semi-trailer or container, preventing theft of loads.

BRIEF DESCRIPTION OF THE DRAWINGS

Other objects and many of the attendant advantages of this invention will be readily appreciated as the same becomes better understood by reference to the following detailed description when considered in connection with the accompanying drawings, in which like reference numerals designate like parts throughout the figures thereof, and wherein.

DESCRIPTION OF PREFERRED EMBODIMENTS

Figure 1:
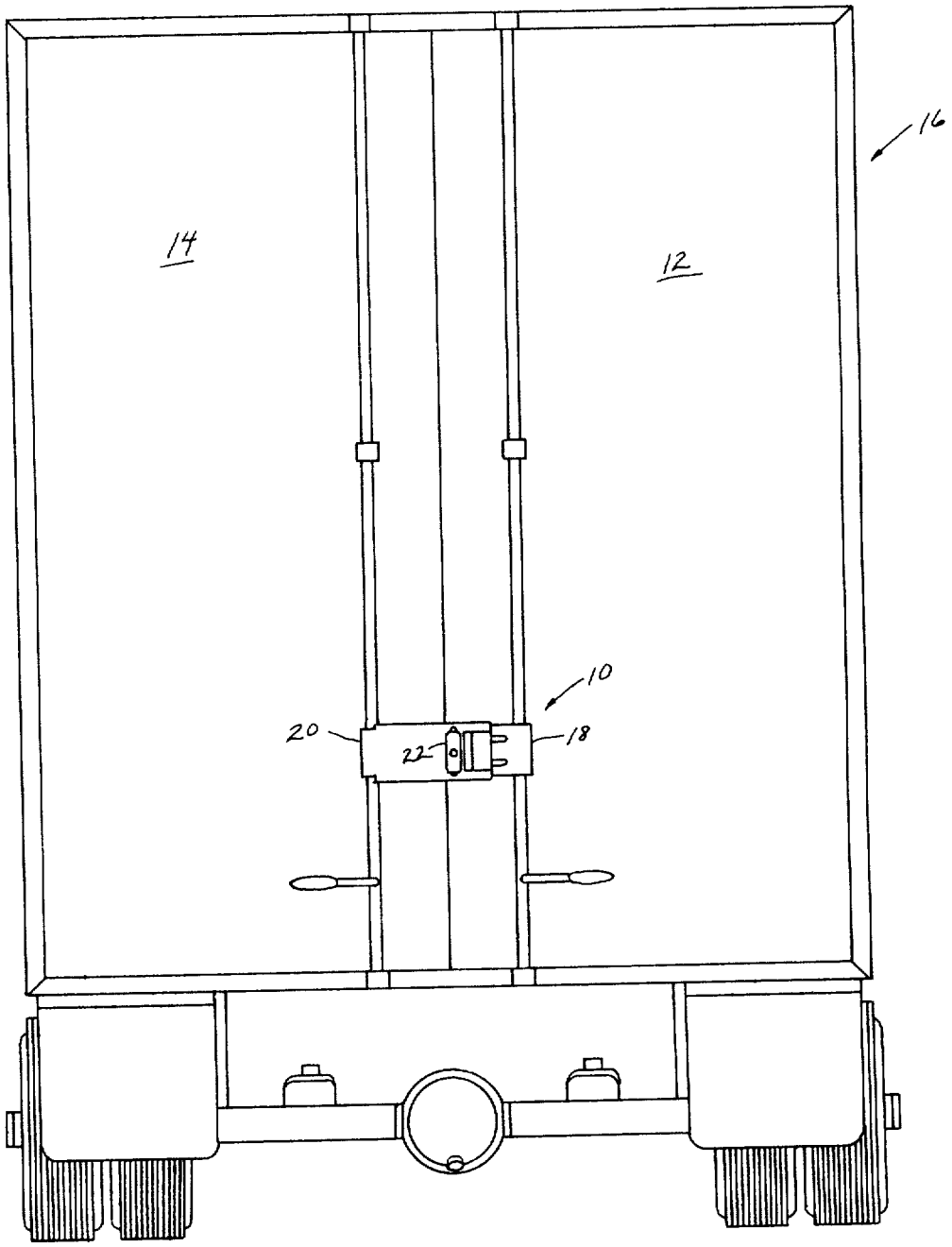
FIG. 1 illustrates a rear view of a semi-trailer having a lock-protecting hasp of the present invention on the two opposing doors of the semi-trailer or container between two bars.

FIG. 1, which illustrates an end view of a lock-protecting hasp, the present invention, shows the lock-protecting hasp 10, secured between bars 12a and 14a of opposing right door 12 and left door 14 of a semi-trailer 16. The lock-protecting hasp 10 includes a male mating J member 20, a female mating J member 18, and a lock 22.

Figure 2:
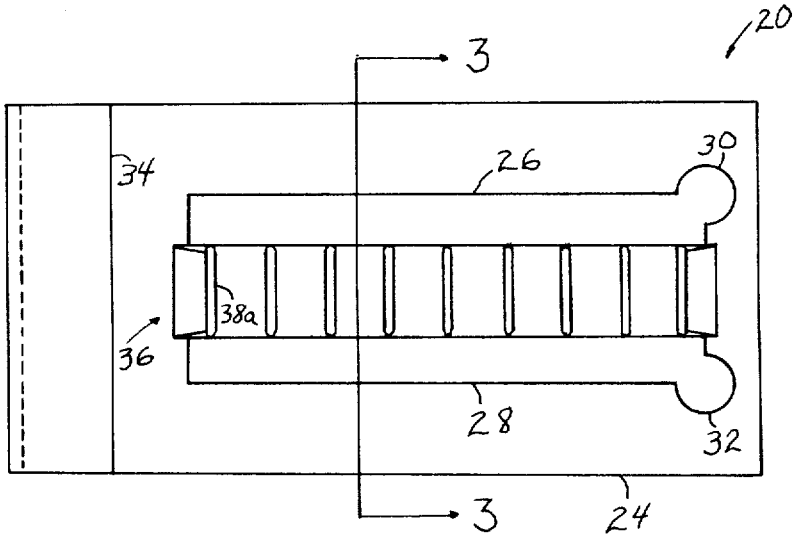
FIG. 2 illustrates a front view of a male mating member of the lock-protecting hasp.

FIG. 2, which illustrates a back view of the male J mating member 20, shows a leg 24 including two opposed longitudinal running slots 26 and 28 having two opposed elongated holes 30 and 32 having an enlarged outer radial circumferences at the upper end of the leg 24, and a U-shaped bend 34 in the lower end of the J member 20. A longitudinal ribbed locking bar 36 having a plurality of upward extending teeth 38*a*–38*i* positions between the slots 26 and 28. The ribbed member 36 geometrically corresponds to the shackle and includes a plurality of ribs, nine in number by way of example and for purposes of illustration only; the space between each of the ribs also geometrically corresponds to the shackle.

Figure 3:
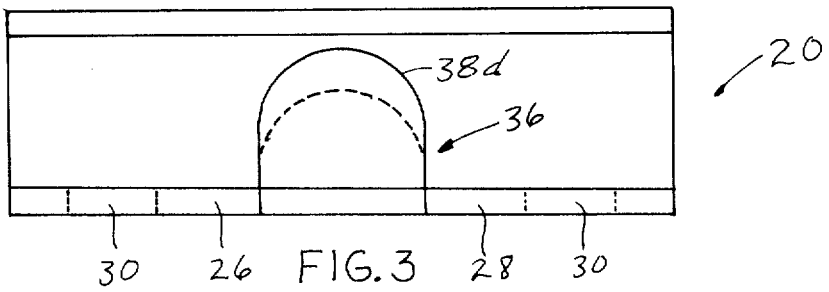
FIG. 3 illustrates a sectional view of the member of FIG. 2 taken along line 3—3 of FIG. 2.

FIG. 3, which illustrates a sectional view taken along line 3—3 of FIG. 2, shows the ribbed member 36, the tooth 38*e*, the longitudinal slots 26 and 28, and the elongated holes 30 and 32 of the male J mating member 20. The ribbed locking bar member 36 provides the adjustability for any bar spacing on trailers or containers.

Figure 4:
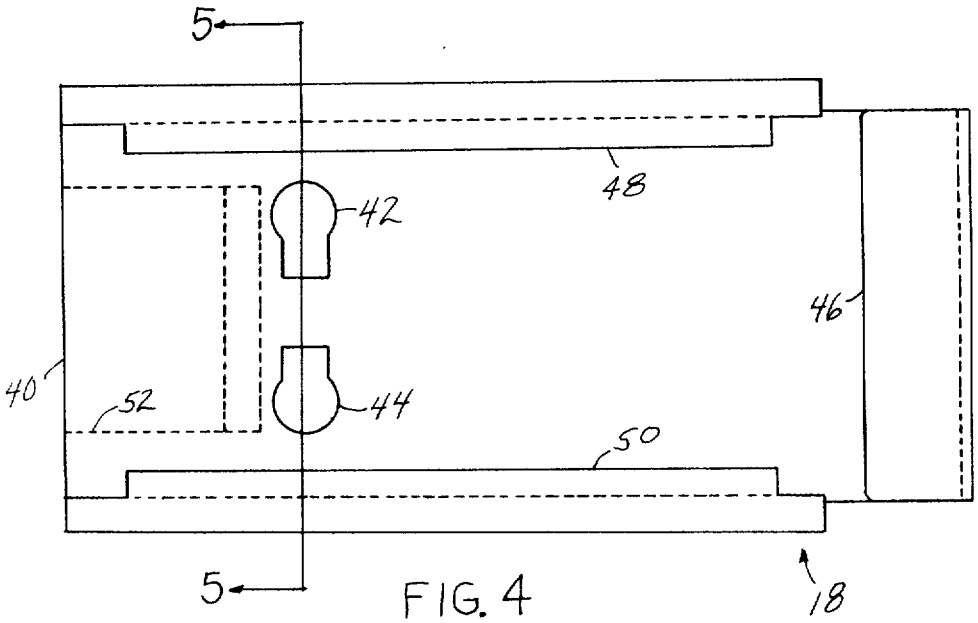
FIG. 4 illustrates a back view of a female mating member of the lock-protecting hasp.

FIG. 4, which illustrates a back view of the female J mating member 18, shows a leg 40 including two opposed elongated holes 42 and 44 having an enlarged outer radial circumference at the upper end of the leg 40, a U-shaped bend 46 in the lower end of the J member 18, and opposing longitudinal right-angle channels 48 and 50 extending upward and inward on the leg 40 of member 18. Protector block 52 as illustrated in imaginary lines positions on the other side of the member 18. The channels 48 and 50 are formed of the same material as the member 18.

Figure 5:
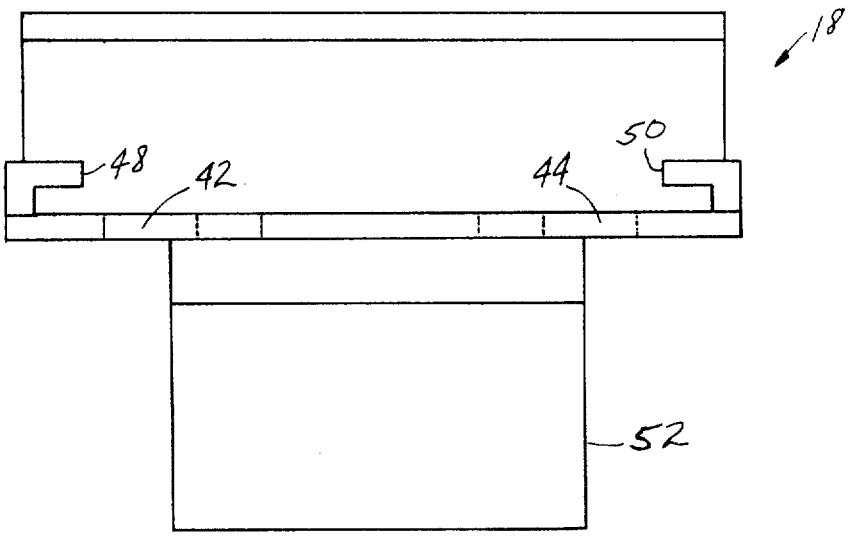
FIG. 5 illustrates a sectional view of the member of FIG. 4 taken along line 5—5 of FIG. 4.

FIG. 5, which illustrates a sectional view taken along line 5—5 of FIG. 4, shows the channels 48 and 50, the elongated holes 42 and 44, and the protector block 52 of the female J mating member 18.

PREFERRED MODE OF OPERATION

The lock-protecting hasp 10 is assembled by mating female member 20 into the channels 48 and 50 of male member 18, and sliding the two members 18 and 20 together so that holes 30 and 42, and holes 32 and 44 align. The lock 22 having an open shackle 22*a* is held in an individual's right hand with the lock body 22 held such that the end of shackle 22*a* for a right-handed individual is positioned through holes 30 and 42, then the lock body is rotated 180° counterclockwise and pulled towards the individual, thereby pulling the end of the shackle through holes 32 and 44 and over the ribbed locking bar 36. The body of the lock 22 is then rotated 180° counterclockwise and pressed against the member 18 whereupon the shackle extends beyond the ribbed locking bar permitting sliding with respect thereto.

The lock-protecting hasp 10 is positioned between bars 12*a* and 14*a* as now described. The U-shaped bend 34 is positioned and engaged around the bar 14*a*, and the member 18 is then engaged against the bar 12*a*. The U-shaped bend 46 on member 18 is then pushed for subsequent engagement with bar 12*a* while the member 18 is sliding over the member 20. Once the U shape bends 34 and 46 engage with bars 12*a* and 14*a*, the individual positions his fingers of his left hand for engaging the lock shackle between the teeth of the ribbed locking bar 38, subsequently pushes the lock body against the shackle and turns the key locking the lock. The lock-protecting hasp is then locked into position by lock 22 securing the holes 42 and 44 of member 18 to the ribbed locking bar 36 of the member 20. Consequently the trailer doors 12 and 14 are locked in position by the lock 22 engaged in the lock-protecting hasp 10.

Figure 6:
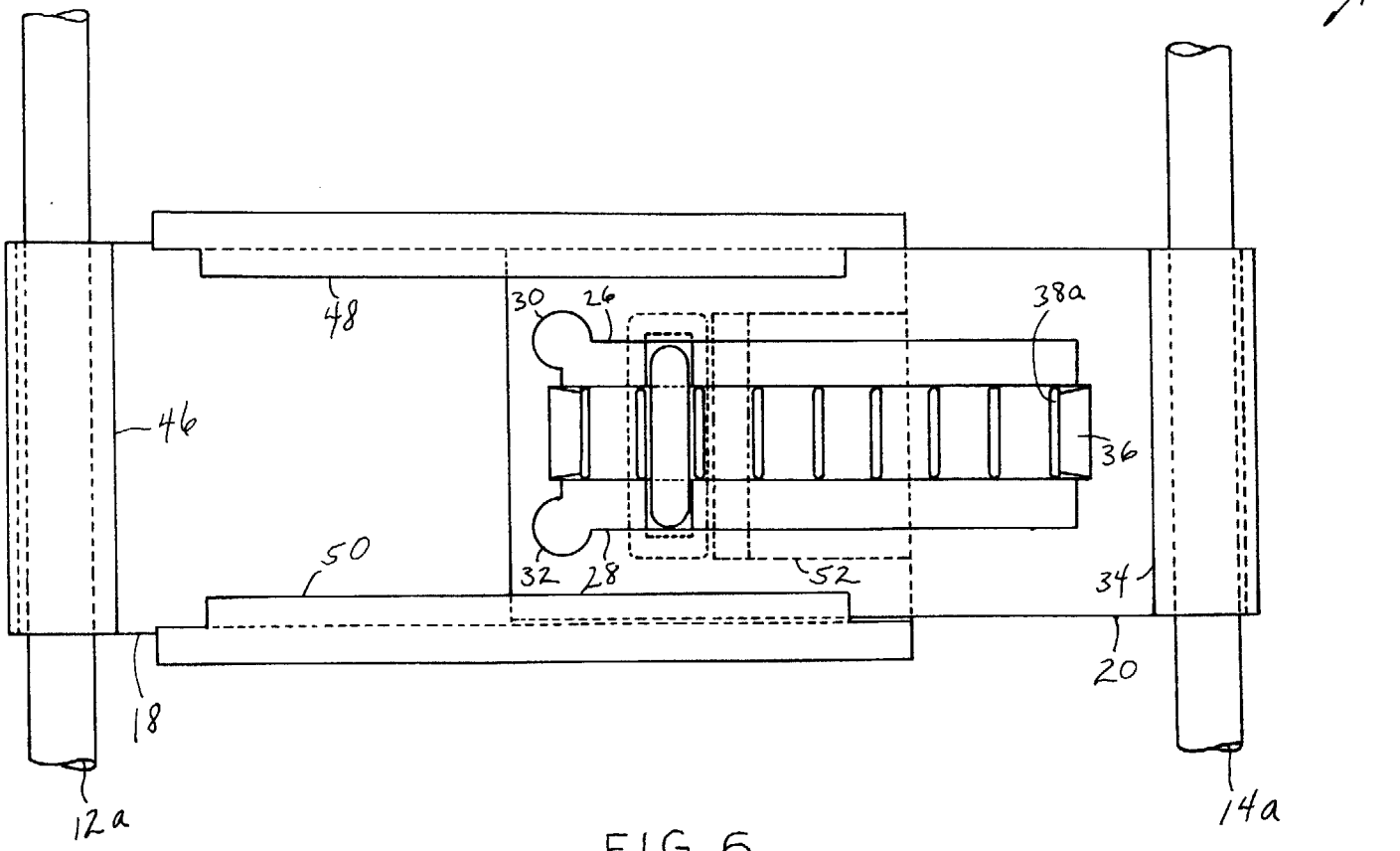
FIG. 6 illustrates an engaged back view of the lock-protecting hasp.

FIG. 6 illustrates the back view of the engaged lock-protecting hasp where all numerals correspond to those elements previously described.

The elements of the present invention can be constructed of 0.164" hot rolled steel with the exception of the ribbed locking member 36 and the lock protector block which are ductile castings.

The lock 22 is removed in a likewise manner after being unlocked with a reverse operation of the steps.

For a left-handed person, the operation would be reversed, the respective operation taking into account the reversal of the structural elements.

The protector block 52 prevents engagement of a pry bar or a cutter about the shackle 22*a* of lock body 22 or in between shackle 22*a* or lock body 22 and any of the structural support of the lock-protecting hasp 10 and accompanying members 18 and 20. The protector block can take any geometrical shape.

ALTERNATIVE EMBODIMENT

Figure 7:
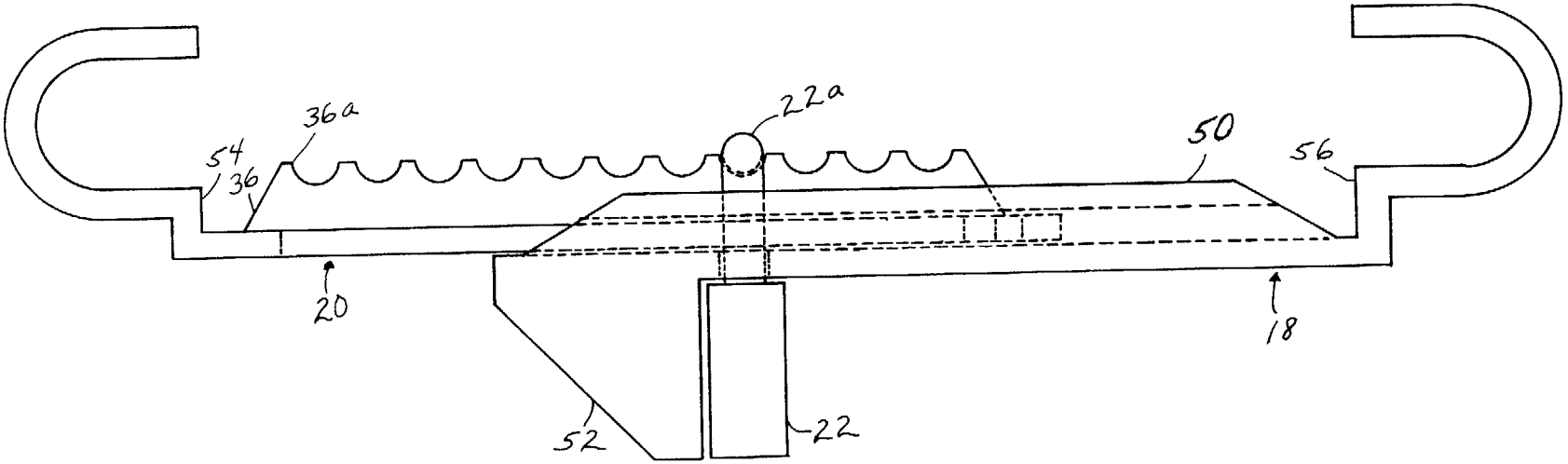
FIG. 7 illustrates an alternative embodiment of the lock-protecting hasp.

FIG. 7, which illustrates an alternative embodiment of the lock-protecting hasp of the present invention, shows a top view of mating member having offset ends 54 and 56. The offset ends provide for trailer doors having a greater depth or for trailer doors having the overlapping weather strip positioned across the seam of the doors. The offsets 54 and 56 are substantially located adjacent each of the U-shaped bends of each member. All other numerals correspond to those elements previously described and operation is identical as previously described in FIGS. 1–6.

Various modifications can be made to the lock-protecting hasp of the present invention without departing from the apparent scope thereof. Each of the outside mounting hasps including the spacer protector block can be cast from steel or other like material and be one continuous member. Depending upon the particular application, the size of the outside mounting hasp and the elongated holes can be varied for different size doors and different size locks. Inherently, the larger the lock and the larger the hasp members, the stronger the lock-protecting hasp system.

Having thus described the invention, what is claimed is:

1. Lock-protecting hasp for use with opposing bars of full swing rear truck trailer doors, said lock-protecting hasp comprising:

opposing aligned male and female mating J-shaped members, each of said mating members including opposing holes, said female member including opposing channels on an inside leg of said J member for accepting said male member and a protector block on an outside leg of said J member, adjacent said opposing holes, said male member including opposing longitudinal slots in a leg of said male member and a longitudinal ribbed locking bar on an inside of said leg between said longitudinal slots whereby a shackle of a lock connects through each of said aligned holes of said mated members and said shackle engages between two of said ribs when said members are adjusted together about bars of said trailer doors and said protector block is adjacent said lock, thereby preventing any area or space exposed between said shackle and said lock body of said legs of said outside mounting hasps.

2. The lock-protecting hasp of claim 1 wherein said opposing channels on each side of said female member sufficiently overlap said sides of said male member.

3. The lock-protecting hasp of claim 1 wherein said space between each rib substantially corresponds geometrically to said shackle of said lock.

4. The lock-protecting hasp of claim 1 comprising a plurality of ribs.

5. The lock-protecting hasp of claim 1 comprising eleven ribs.

6. The lock-protecting hasp of claim 1 wherein said longitudinal slots are of a width slightly larger than said diameter of said shackle of said lock thereby providing for positioning of said shackle.

7. The lock-protecting hasp of claim 1 wherein said holes comprise elongated holes including an outer radial circumference on each of said holes providing for rotation of said shackle within said hole.

8. The lock-protecting hasp of claim 1 comprising a protector block affixed to a top end of said leg of said female member adjacent said holes whereby said protector block secures any space between such shackle and said block preventing any prying between said block and body of said lock.

9. The lock-protecting hasp of claim 1 comprising an offset bend in each leg of said members adjacent the J of each of said members.

10. The lock-protecting hasp of claim 1 wherein said members are 0.164" hot rolled steel.

11. The lock-protecting hasp of claim 1 wherein said ribbed locking member and protector block are ductile castings.

12. Lock-protecting hasp for bars on at least one door and adjacent aligned member comprising: male and female aligned and engageable hasps, each of said hasps including J-shaped structure, two elongated opposing holes in a leg of each of said J for accepting a shackle of a lock and including outer radial circumferences on each of said elongated holes providing for rotation of said shackle of said lock in each said leg, longitudinal opposing slots in said male mating J member and including a longitudinal ribbed locking bar positioned between said slots on the inside of said male J member, longitudinal channels running substantially the length of said female J member on the inside of said female J member to receive the male J member, and a protector block secured to an outer end of an outside of said female J mating member and adjacent said elongated holes whereby said male and female J portion engages over said bars and said ribbed locking bar provides for adjustable securing of said hasps by said lock shackle interlocking with said ribbed member thereby securing said bars of said door and member.

* * * * *